US006817898B2

(12) United States Patent
Tanaka et al.

(10) Patent No.: US 6,817,898 B2
(45) Date of Patent: Nov. 16, 2004

(54) ELECTRICAL CONNECTOR

(75) Inventors: Yukitaka Tanaka, Musashimurayama (JP); Ryoji Sugiyama, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/260,889

(22) Filed: Sep. 30, 2002

(65) Prior Publication Data

US 2003/0064614 A1 Apr. 3, 2003

(30) Foreign Application Priority Data

Oct. 2, 2001 (JP) ..... 2001-306336

(51) Int. Cl.[7] ..... H01R 9/05
(52) U.S. Cl. ..... 439/579; 439/610
(58) Field of Search ..... 434/98, 607, 608, 434/609, 610, 579, 580

(56) References Cited

U.S. PATENT DOCUMENTS 5,460,533 A * 10/1995 Broeksteeg et al. ..... 439/108
5,509,827 A * 4/1996 Huppenthal et al. ..... 439/638
6,280,209 B1 8/2001 Bassler et al.
6,350,134 B1 * 2/2002 Fogg et al. ..... 439/79
6,471,548 B2 * 10/2002 Bertoncini et al. ..... 439/608
6,524,135 B1 * 2/2003 Feldman et al. ..... 439/610
6,540,559 B1 * 4/2003 Kemmick et al. ..... 439/608
6,547,595 B2 * 4/2003 Tanaka ..... 439/607

FOREIGN PATENT DOCUMENTS

| | | |
|---|---|---|
| EP | 1 052 739 | 11/2000 |
| JP | 10-032053 | 2/1998 |
| JP | 2000-348823 | 12/2000 |

* cited by examiner

*Primary Examiner*—Ross Gushi
(74) *Attorney, Agent, or Firm*—Michael Best & Friedrich LLP

(57) ABSTRACT

In a non-symmetric pin assignment where a differential pair of contacts and a ground contact are arranged in that order, a conductive finger portion electrically connected to the ground contact is also arranged in the proximity of one of the differential pair of contacts which is positioned farther from the ground contact, so that an imbalance on impedance arising from the non-symmetric pin assignment is compensated. In the case where the differential pair of contacts and the ground contact are arranged in the same horizontal line, the conductive finger portion is located above or below the contact farther from the ground contact.

16 Claims, 17 Drawing Sheets

ELECTRICAL CONNECTOR

BACKGROUND OF THE INVENTION

This invention relates to an electrical connector, which will simply be referred to as "connector", and in particular, to a connector for use in a high-speed signal transmission system.

In the prior art of a connector for the high-speed signaling or the differential signaling, a connector has a pair of contacts for receiving/transmitting a pair of signals opposite in voltage, that is a pair of positive and negative voltage signals. The differential signaling is often used in the high-speed transmission system in order to achieve excellent noise immunity. The paired contacts will be called a "differential pair of contacts". Similarly, the paired signals will be called a "differential pair of signals".

A differential pair of signals are transmitted through a pair of signal lines, for example, a pair of coaxial cables, twin (parallel) coaxial cable, or a twin (twisted) axial cable (twinax cable), from or to a connector. In the case of using coaxial cables, a pair of center conductors, which are center conductors of the pair of coaxial cables (namely, a pair of positive and negative signal lines), are connected to the differential pair of contacts in the connector. A pair of outer conductors of the pair of coaxial cables are bundled and are connected to a ground contact in the connector. In the case of using a twin-(parallel) coaxial cable, the pair of inner conductors of the twin coaxial cable are connected to differential pair of contacts in the connector, while an outer conductor of the twin-coaxial cable is connected to a ground contact in the connector. In use of the twinax cable, twisted twin conductors are connected to the differential pair of contacts, respectively, while a drain line is connected to the ground contact.

It should be here considered that a connector usually comprises a plurality of contacts arranged in rows of contacts and each row may include two differential pairs of contacts. In this case, a single ground contact is generally arranged between two differential pairs of contacts, in order to minimize interference between two differential pairs of signals passing through the two differential pairs of contacts and to minimize the number of contacts in a connector. That is, a differential pair of contacts, a ground contact and another differential pair of contacts are arranged in that order so that the ground contact is shared by the different pairs of contacts. As an example of such pin (contact) assignments, there is an existing connector compliant to the physical interconnect specification of the DVI (Digital Video Interface) made by the DDWG (Digital Display Working Group whose URL is "http://www.ddwg.org/"). Specifically, a connector compliant to the DVI specification supports Transmission Minimized Differential Signaling (TMDS) so that a differential pair of contacts receive/transmit a pair of positive and negative signals, that is, a differential pair of signals, under the TMDS.

The present inventors point out here that the above-mentioned pin assignments are non-symmetric ones and that one contact of a differential pair of contacts is farther than the other of the differential pair of contacts from a corresponding ground contact. In addition, an imbalance on impedance might arise from the non-symmetric pin assignments and, if arising, it makes electrical path lengths of a differential pair of positive and negative signals different from each other because the physical path lengths of the differential pair of signals are usually the same. If there is a large difference in electrical path lengths of a differential pair of signals, a critical difference occurs between transmission delays of the differential pair of signals so that the differential pair of signals do not suitably work any longer. Therefore, an impedance imbalance arising from the non-symmetric pin assignments should be compensated.

Furthermore, it is required that an output impedance of a connector, especially, on every contact is normally predefined in order to make an impedance matching between it and an input impedance of a mating connector on every contact. This requirement has to be met on compensating the imbalance mentioned above.

SUMMARY OF THE INVENTION

It is therefore an object of the present invention to provide a connector which can compensate an imbalance arising from the non-symmetric pin assignments while meeting the requirement of an impedance matching.

In accordance with one aspect of the present invention, a connector is provided for connecting at least first and second signal lines and a ground line with a mating connector fitable to said connector, said connector comprising a ground plate (1), an insulator (30), first and second contacts (21) being to be connected with said first and second signal lines, respectively, and a ground contact (22) being to be connected with said ground line, said ground plate (1) being electrically connected with said ground contact (22), said insulator (30) supporting therein said first and second contacts (21) and said ground contact (22) in accordance with predetermined pin assignments where said first and second contacts (21) and said ground contact (22) are arranged in the same row so that said first contact (21, 108) is positioned farther than said second contact (21,107) from said ground contact (22, 106), said connector being characterized by provision of a conductive finger portion (3) disposed in the proximity of and along said first contact (21, 108), said conductive finger portion (3) being electrically connected with said ground plate (1).

Specifically, said insulator (30) has first to third through holes (35) and an additional hole (34), said first to third through holes (35) being arranged in the same horizontal line so as to receive said first and second contacts (21), and said ground contact (22) inserted thereinto, respectively, in accordance with said predetermined pin assignments, said additional hole (34) accommodating therein said conductive finger portion (3) and being located above or below said first through hole (35) in the insulator (30).

Said first and second contacts can be used for receiving and transmitting a differential pair of signals, respectively, and, for example, can be positive and negative, respectively, alternatively, negative and positive, respectively.

Preferably, said conductive finger portion (3) is formed integrally with said ground plate (1).

DESCRIPTION OF PREFERRED EMBODIMENTS

Figure 1:
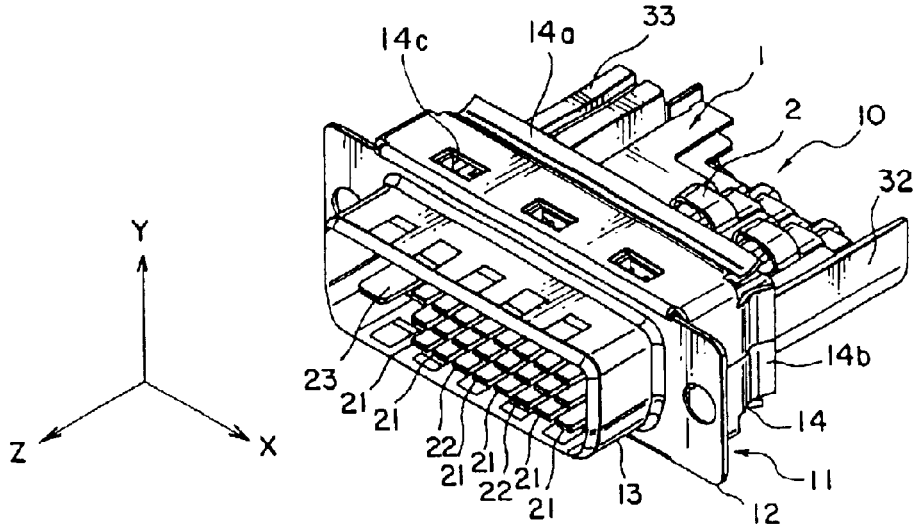
FIG. 1 is a perspective view showing a connector in accordance with an embodiment of the present invention.
Figure 2:
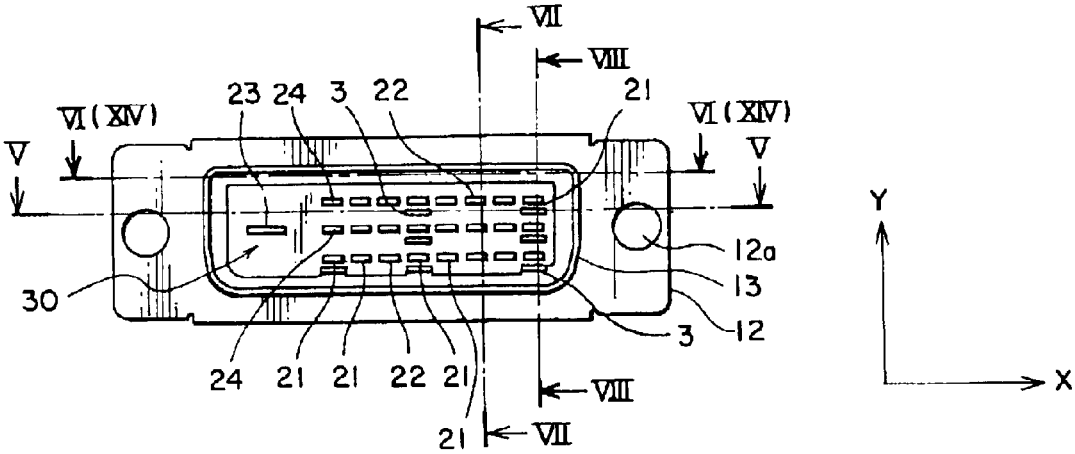
FIG. 2 is a front view of the connector illustrated in FIG. 1.
Figure 3:
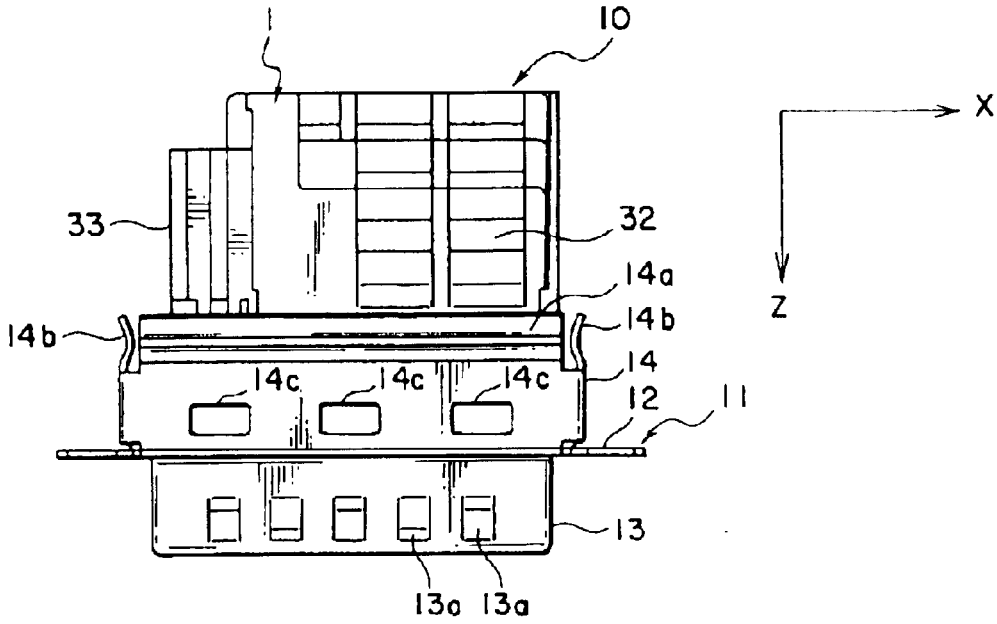
FIG. 3 is a top plan view of the connector illustrated in FIG. 1.
Figure 4:
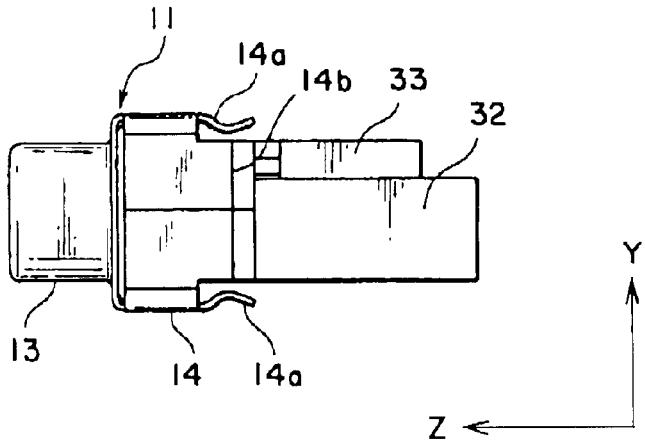
FIG. 4 is a side view of the connector illustrated in FIG. 1.
Figure 5:
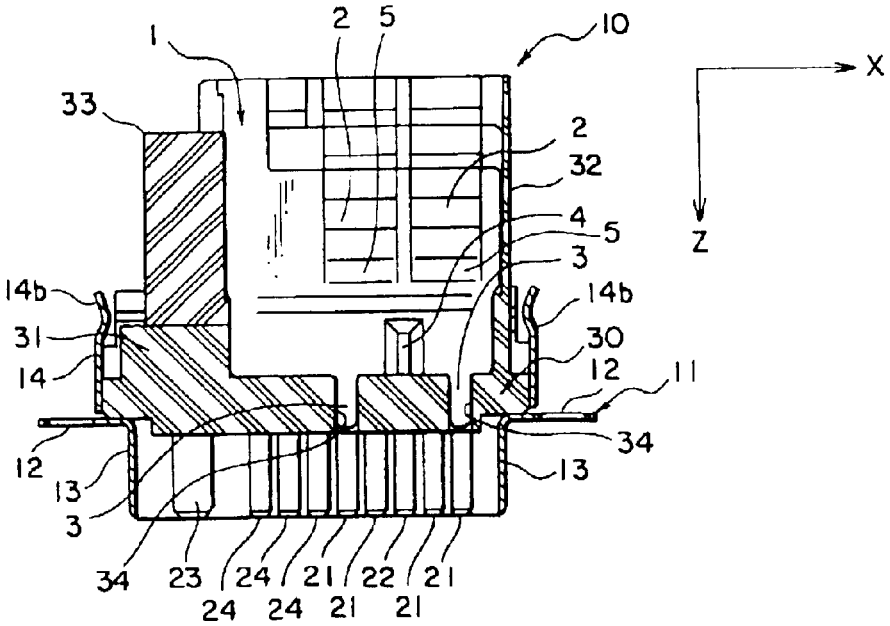
FIG. 5 is a cross-sectional view of the connector taken along lines V—V of FIG. 2.
Figure 6:
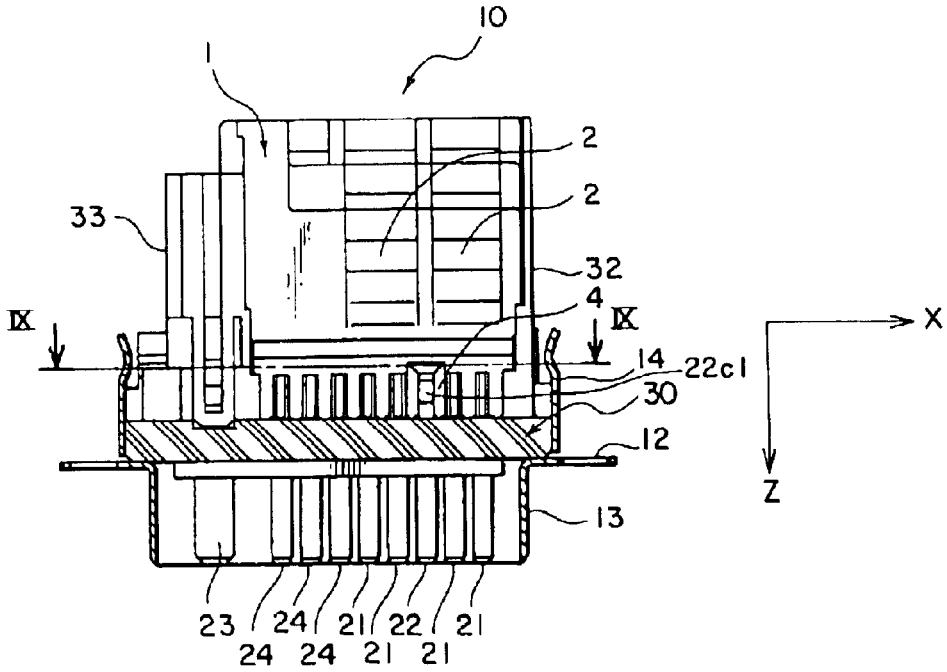
FIG. 6 is a cross-sectional view of the connector taken along lines VI—VI of FIG. 2.

A connector according to an embodiment of the present invention is used in a system for transmitting high-frequency signals between a personal computer and its monitor.

With reference to FIGS. 1 to 9, the connector 10 comprises a plurality of contacts 21, 22, and 24, an insulator housing 30 supporting therein the contacts 21, 22 and 24, a shell 11 surrounding the contacts 21, 22 and 24 and the insulator housing 30, and ground plates 1 (1*a*, 1*b*, 1*c*). The front end of the connector 10 in a Z-direction is formed with a fitting portion for a mating connector, which is not shown. That is, the Z-direction is an insertion direction of the connector for the mating connector. On the other hand, cables carrying the high-speed signals are fixed on the rear side of the connector 10 in the Z-direction. The installation of the cables is described later with reference to further drawings. In addition, a key 23 is provided, as a positioning means on the insertion for the mating connector, in the fitting portion of the front side in the Z-direction. The key 23 may be omitted, depending on the strength of the shell 11, the contacts 21, 22, 24 and so on.

In the present embodiment, the connector 10 has twenty-four contacts 21, 22, 24. The contacts depicted with the reference numeral 21 are signal contacts for receiving or transmitting the differential pair of signals in the high-speed signal transmission system. That is, two adjacent contacts 21 form a differential pair of contacts. The contacts depicted with the reference numeral 22 are ground contacts and are connected to corresponding ones of the ground plates 1, respectively. The contacts depicted with the reference numeral 24 are contacts which are used for a particular purpose other than high-speed signal transmission and a ground thereof.

Figure 10:
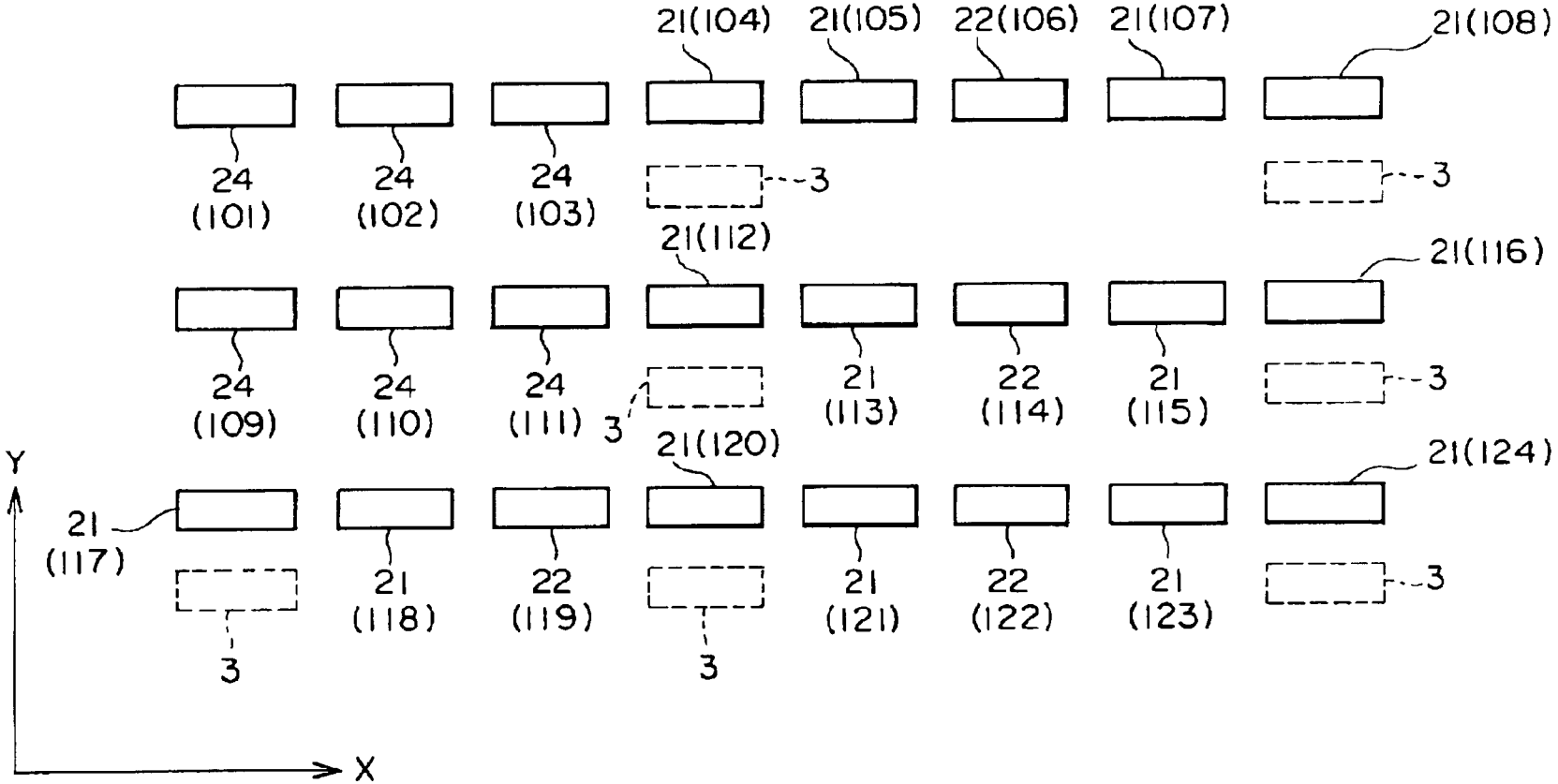
FIG. 10 is a view schematically showing pin assignments in the connector of FIG. 1.

The pin assignments of the contacts 21, 22, 24 are specifically shown in FIG. 10, wherein a Y-direction is from the bottom to the top of the connector 10, while an X-direction is from the left side to the right side of the connector 10 as seen from the front side of the connector 10. For the sake of clarity, a unique reference numeral is also assigned to every contact in FIG. 10, the unique reference numeral of each contact being shown in the parentheses corresponding to the contact.

With reference to FIG. 10, the contacts 21, 22, 24 (namely, 101 to 124) are arranged in three rows, namely, a top row, a middle row, and a bottom row, each of which comprises eight contacts 101 to 108, 109 to 116, and 117 to 124. In other words, those contacts are arranged in eight columns each column including three contacts. In detail, the top row comprises three contacts 24 (101 to 103), four signal contacts 21 (104, 105, 107, 108) and one ground contact 22 (106). Among them, the two adjacent ones of signal contacts 21 (104, 105) are a differential pair of contacts, while the other two adjacent ones of the signal contacts 21 (107, 108) are another differential pair of contacts. These two differential pairs of contacts 21 (104, 105, 107, 108) share the ground contact 22 (106) disposed therebetween. The middle row comprises three contacts 24 (109 to 111), four signal contacts 21 (112, 113, 115, 116) and one ground contact 22 (114). Among them, two adjacent ones of the signal contacts 21 (112, 113) are a differential pair of contacts, while the other two adjacent signal contacts 21 (115, 116) are another differential pair of contacts. These two differential pairs of contacts 21 (112, 113, 115, 116) share the ground contact 22 (114) disposed therebetween. The bottom row comprises six signal contacts 21 (117, 118, 120, 121, 123, 124) and two ground contacts 22 (119, 122). Among them, two adjacent ones of the signal contacts 21 (117, 118) are a differential pair of contacts and one of the ground contacts 22 (119) corresponds to the differential pair of contacts. In addition, another two adjacent ones of the signal contacts 21 (120, 121) are another differential pair of contacts, while the other two adjacent ones of the signal contacts 21 (123, 124) are yet another pair of contacts. These two differential pairs of contacts 21 (120, 121, 123, 124) share the other one of ground contact 22 (122) disposed therebetween.

The connector 10 further comprises seven conductive finger portions, conductive tab portion, or thin or narrow conductive members 3, which are shown by broken lines in FIG. 10. Every conductive finger portion 3 is electrically connected through the ground plates 1 to the ground contacts 22 (106, 114, 118, 122). In addition, each conductive finger portion 3 is arranged in the proximity of the signal contact 21 (104, 108, 112, 116, 117, 120, 124) which is positioned farther than the other signal contact 21 (105, 107, 113, 115, 118, 121, 123) from the ground contact 22 (106, 114, 119, 122) in each of the differential pairs of contacts. Specifically, each of the illustrated conductive finger portions 3 is located below the corresponding signal contact 21 (104, 108, 112, 116, 117, 120, 124), but may be located above thereof. The conductive finger portions 3 compensate the impedance imbalance arising from the pin assignments of the signal contacts 21 mentioned above, by adjusting the impedance of the signal contacts (104, 108, 112, 116, 117, 120, 124) to the substantially same level as that of the respective the other signal contacts (105, 107, 113, 115, 118, 121, 123).

Figure 11:
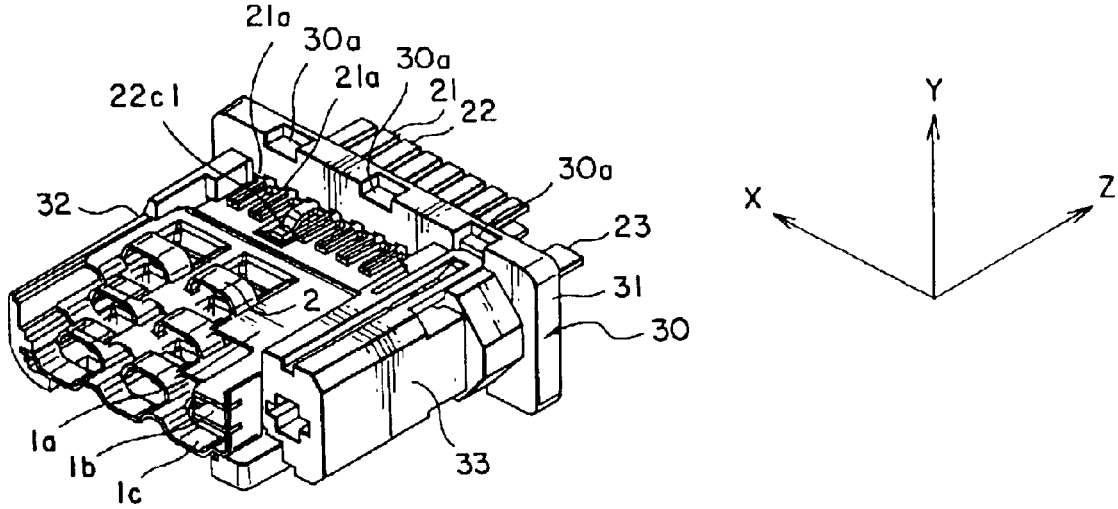
FIG. 11 is a perspective view of an insulator housing as seen from the rear of the insulator, with a shell of the connector of FIG. 1 removed.
Figure 12:
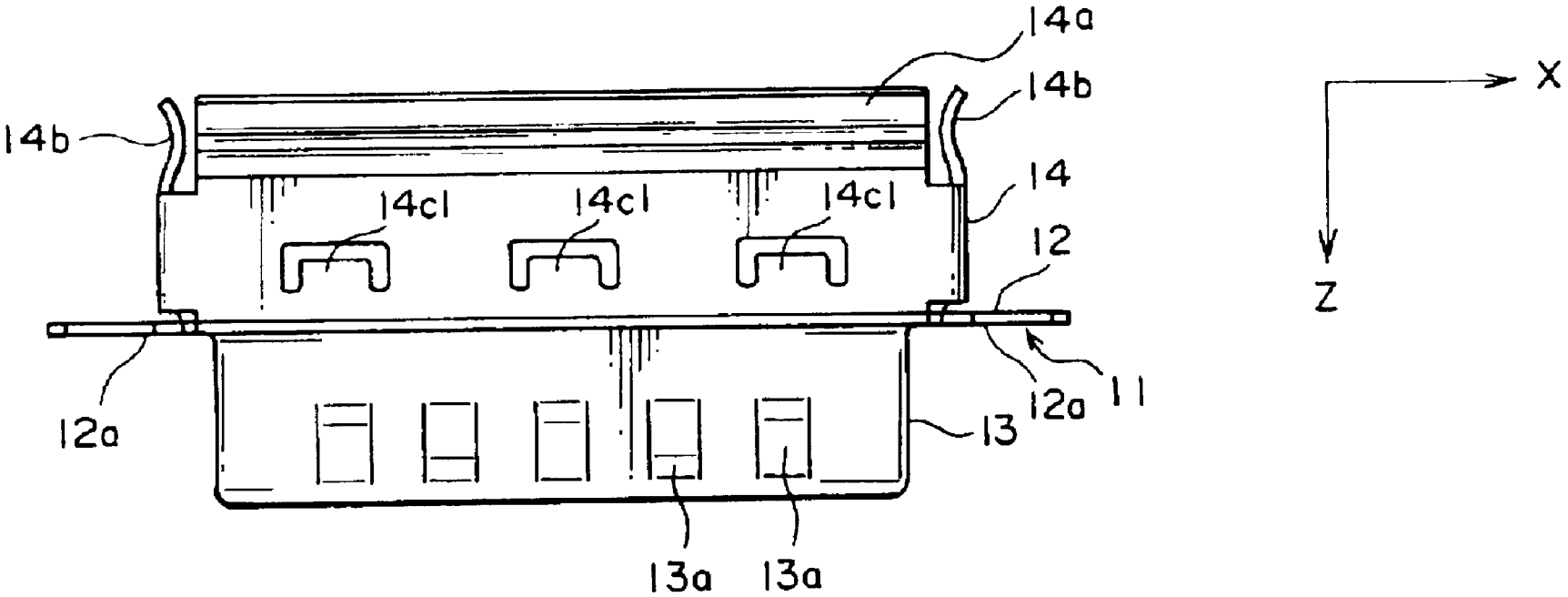
FIG. 12 is a top plan view of the shell of the connector of FIG. 1, the shell being not fit with the insulator.
Figure 13:
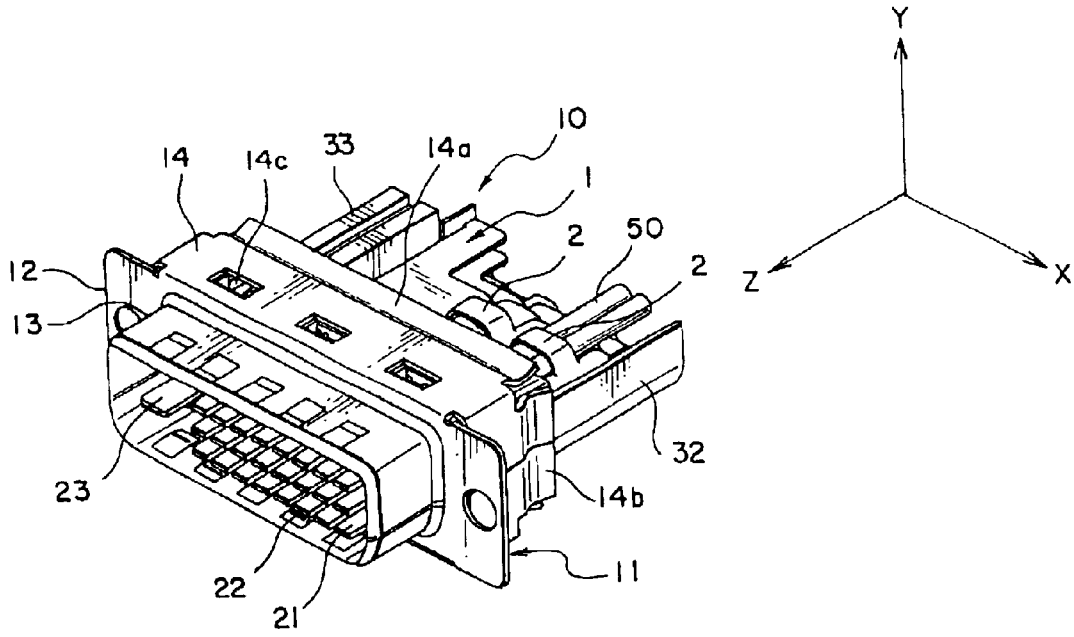
FIG. 13 is a perspective view showing the connector of FIG. 1 with two coaxial cables being connected therewith.
Figure 14:
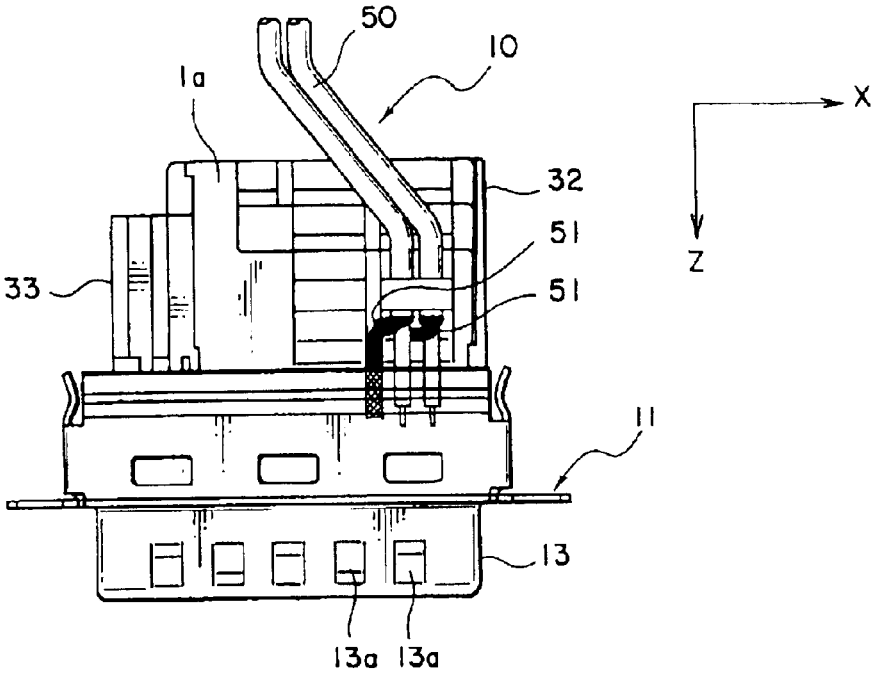
FIG. 14 is a top plan view of the connector of FIG. 13, to which the coaxial cables are connected.
Figure 15:
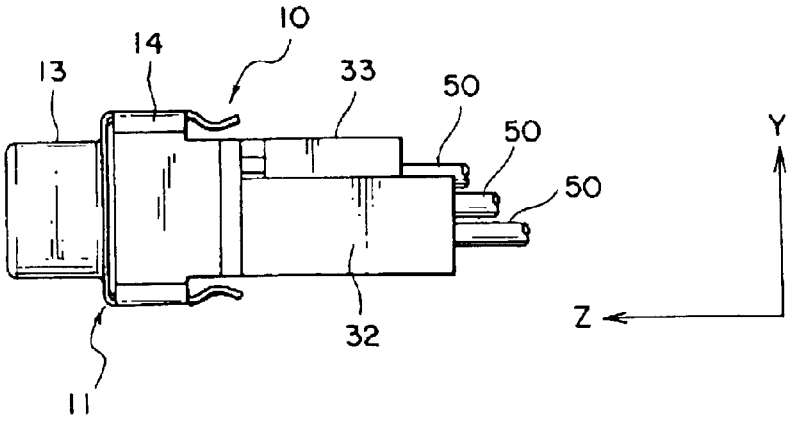
FIG. 15 is a side view of the connector of FIG. 13, to which the coaxial cables are connected.
Figure 16:
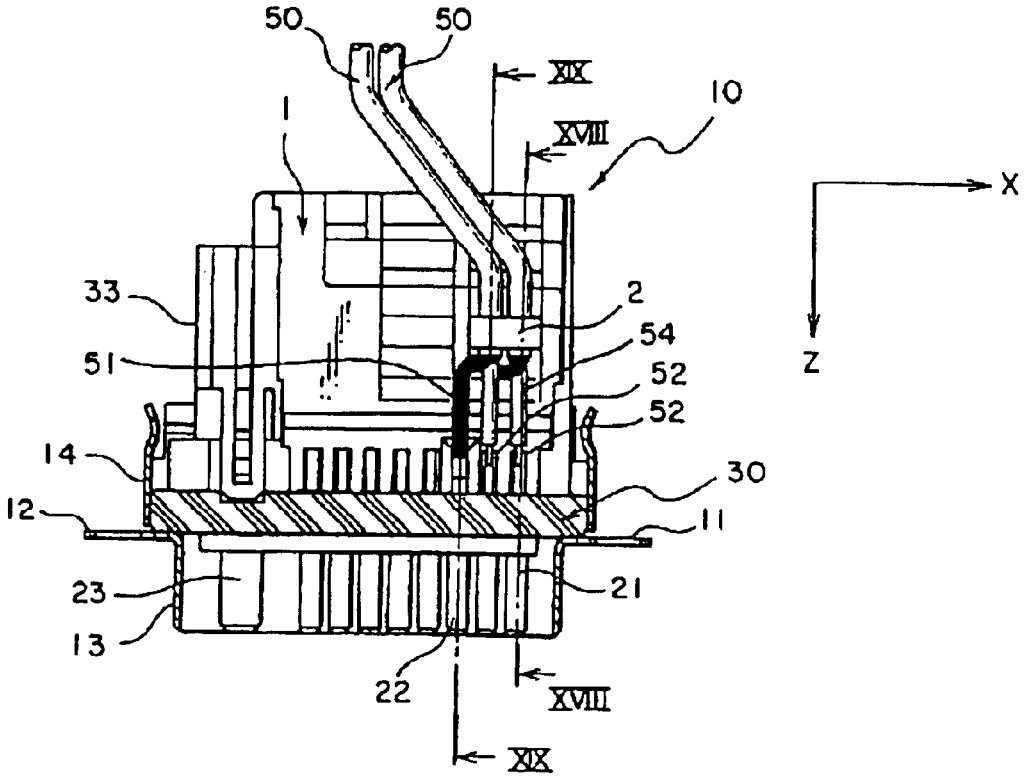
FIG. 16 is a cross-sectional view of the connector taken along lines XVI—XVI of FIG. 2, to which the coaxial cables are connected.

Now, the structure of the connector is described in more detail with also reference to FIGS. 11 and 12 in addition to FIGS. 1–10.

The shell 11 comprises a front tubular portion 13 for being fitted with the mating connector installed for example on a board of an electronic device not shown, a rear tubular portion 14 having a shape of a rectangular tube, and two flange portions 12 outwardly projecting opposite to each other in the X-direction from a joint portion between the front tubular portion 13 and the rear tubular portion 14. The flange portions 12 have circular holes 12*a* for screws used for fixing and ensuring the connection between the connector 10 and the mating connector. The front tubular portion 13 has dimples 13*a* in its top and bottom outer surfaces, which serve to insure the electrical connection between the shell 11 of the connector 10 and a shell of the mating connector.

The rear tubular portion 14 is provided with edge portions 14*a*, 14*a*, 14*b*, 14*b* on the top, the bottom, and the opposite sides at the end portion thereof, those edge portions being bent toward the inside and then slightly divergent rearwardly. In addition, the rear tubular portion 14 is also provided with five openings 14*c* in the top and the bottom walls thereof. Before the insulator housing 30 is installed in the rear tubular portion 14, the rear tubular portion 14 is provided with hook portions 14*c*1 in the top and the bottom walls by making five U-shaped incisions or lance slits in the top and the bottom walls (e.g. see FIG. 12). When the insulator housing 30 is installed in the rear tubular portion 14, the hook portions 14*c*1 are bent toward the insulator housing installed in the rear tubular portion 14, so that the openings 14*c* are formed in the top and bottom walls of the rear tubular portion 14 as mentioned above. Resultantly, the bent hook portions 14*c*1 are accommodated in recess portions 30*a* (see FIGS. 9 and 11) of the insulator housing 30 thereby to fix the insulator housing 30 to the shell 11.

The insulator housing 30 comprises a guide housing 31 and ground plate supporters 32, 33. The guide housing 31 has a plate-like shape, in which the contacts 21, 22, 24, the key 23 and so on are press-fitted and held. In more detail, the guide housing 31 has a plurality of through holes 35 (clearly shown in FIG. 7), a plurality of additional holes 34 (clearly shown in FIGS. 5 and 8), and five recess portions 30*a* (clearly shown in FIGS. 9 and 11). The recess portions 30*a* are for accommodating therein the hook portions 14*c*1 of the rear tubular portion 14, as mentioned above. In detail, the insulator housing 30 with the ground plates 1 and the contacts 21, 22, 24 (e.g. see FIG. 11) is inserted into the shell 11 (e.g. FIG. 12) in the Z-direction, and then, the hook portions 14*c*1 are bent toward the inside so that the insulator housing 30 is fixed in the shell 11.

The through holes 35 are arranged in three rows each comprising eight holes. That is, the through holes 35 have the same arrangement as the contacts 21, 22, 24 described above. In the through holes 35, the contacts 21, 22, 24 are inserted from the rear side of the guide housing 31, so as to be suitably supported by the guide housing 31.

The additional holes 34 are formed below the through holes 35 corresponding to the signal contacts 21 (104, 108, 112, 116, 117, 120, 124) which are positioned away from the respective ground contacts 22 (106, 114, 119, 122), as clearly shown in FIG. 10. In the additional holes 34, the conductive finger portions 3 are inserted from the rear side of the guide housing 31, so as to be suitably fitted in the guide housing 31. Specifically, the additional holes 34 of the present embodiment are through holes.

The ground plate supporters 32, 33 are disposed with a space left threrebetween on the back of the guide housing 31and extend rearward (left-downward on the drawing sheet of FIG. 11) from the guide housing 31 in parallel to each other. The ground plates 1 (1*a*, 1*b*, 1*c*) bridge the ground plate supporters 32, 33 and are supported at the opposite sides of the ground plates by the ground plate supporters. The ground plate supporters 32, 33 are formed integrally with the guide housing 31. The guide housing 31 and the ground plate supporters 32, 33 are made for example of synthetic resin.

Figure 7:
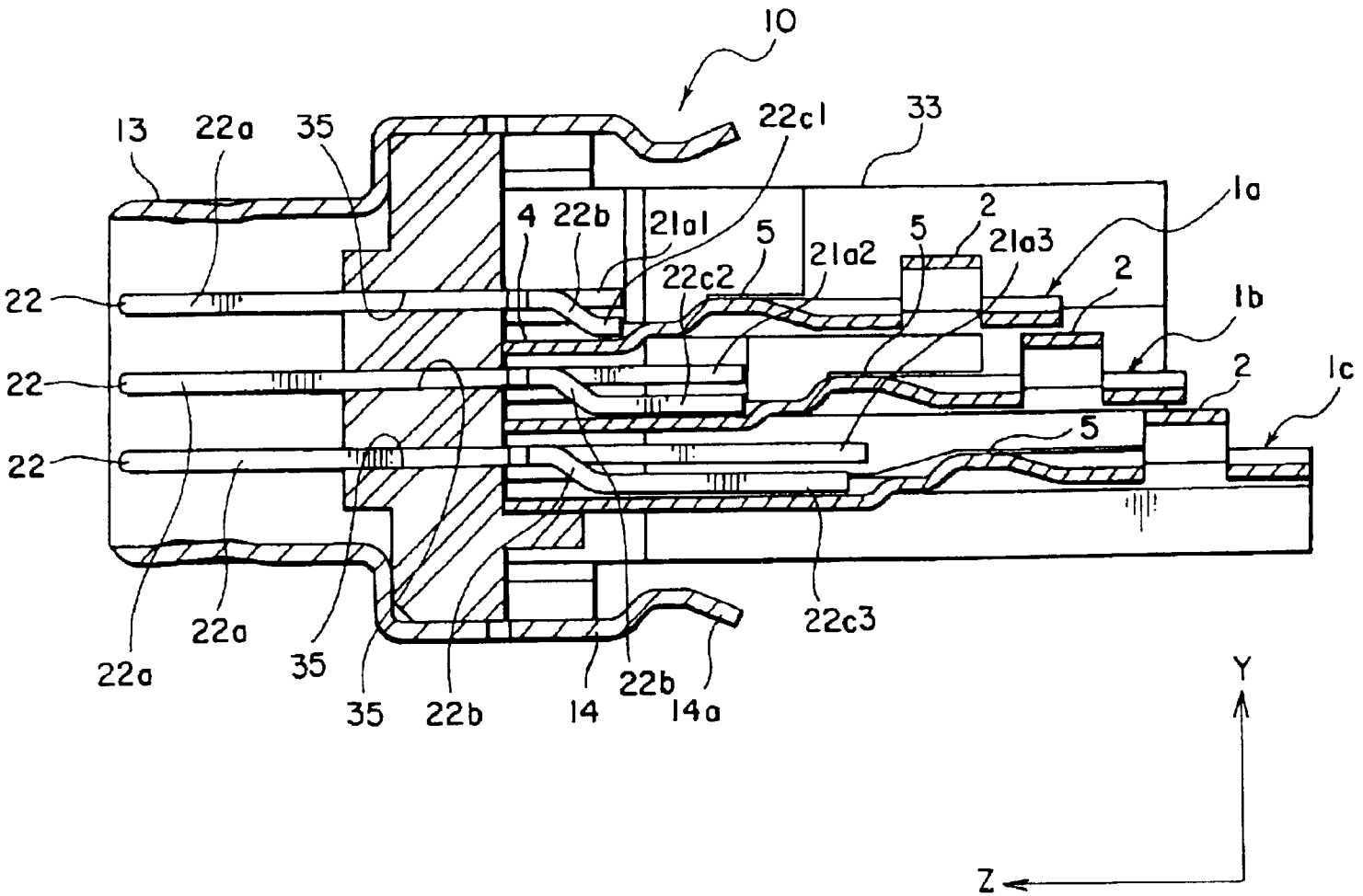
FIG. 7 is a cross-sectional view of the connector taken along lines VII—VII of FIG. 2.

The contacts 21 and 24 have tail or terminating portions 21*a* (21*a*1, 21*a*2, 21*a*3) and 24*a*, respectively. The tail portions 21*a* (21*a*1, 21*a*2, 21*a*3) and 24*a* are formed longer as being in the lower row of the three rows of contacts 21 and 24 (e.g. see FIG. 8). In the other words, the tail portions 21*a* (21 al, 21*a*2, 21*a*3) and 24*a* are formed with increasing lengths in the order from the top to the bottom row of the three rows of contacts 21 and 24. Each of the ground contacts 22 has first to third portions 22*a*, 22*b*, 22*c*1 to 22*c*3, as shown in FIG. 7. The first portion 22*a* extends straightly in the Z-direction and is supported by the through holes 35 as described above. The second portion 22*b* extends from the first portion 22*a* to make an obtuse angle with the first portion 22*a* as shown in FIG. 7. The third portion 22*c*1, 22*c*2, 22*c*3 extends from the second portion 22*b* to make an obtuse angle with the second portion 22*b*. As seen from FIG. 7, the first and third portions 22*a*, 22*c*1, 22*c*2, 22*c*3 are substantially parallel to each other. The obtuse angle made by the first and second portions 22*a*, 22*b* is substantially equal to the obtuse angle made by the second and the third portions 22*b*, 22*c*1, 22*c*2, 22*c*3. In addition, the third portions 22*c*1, 22*c*2, 22*c*3 of the ground contacts 22 are formed longer as being in the lower row of the three contact rows (e.g. see FIG. 7).

In the embodiment described above, twenty-four (24) contacts are arranged in three rows and eight columns of a matrix. However, it is of course that any number of contacts can be arranged in different number of rows and columns, as desired in designing of connector. Further, different rows can have different number of contacts.

Figure 8:
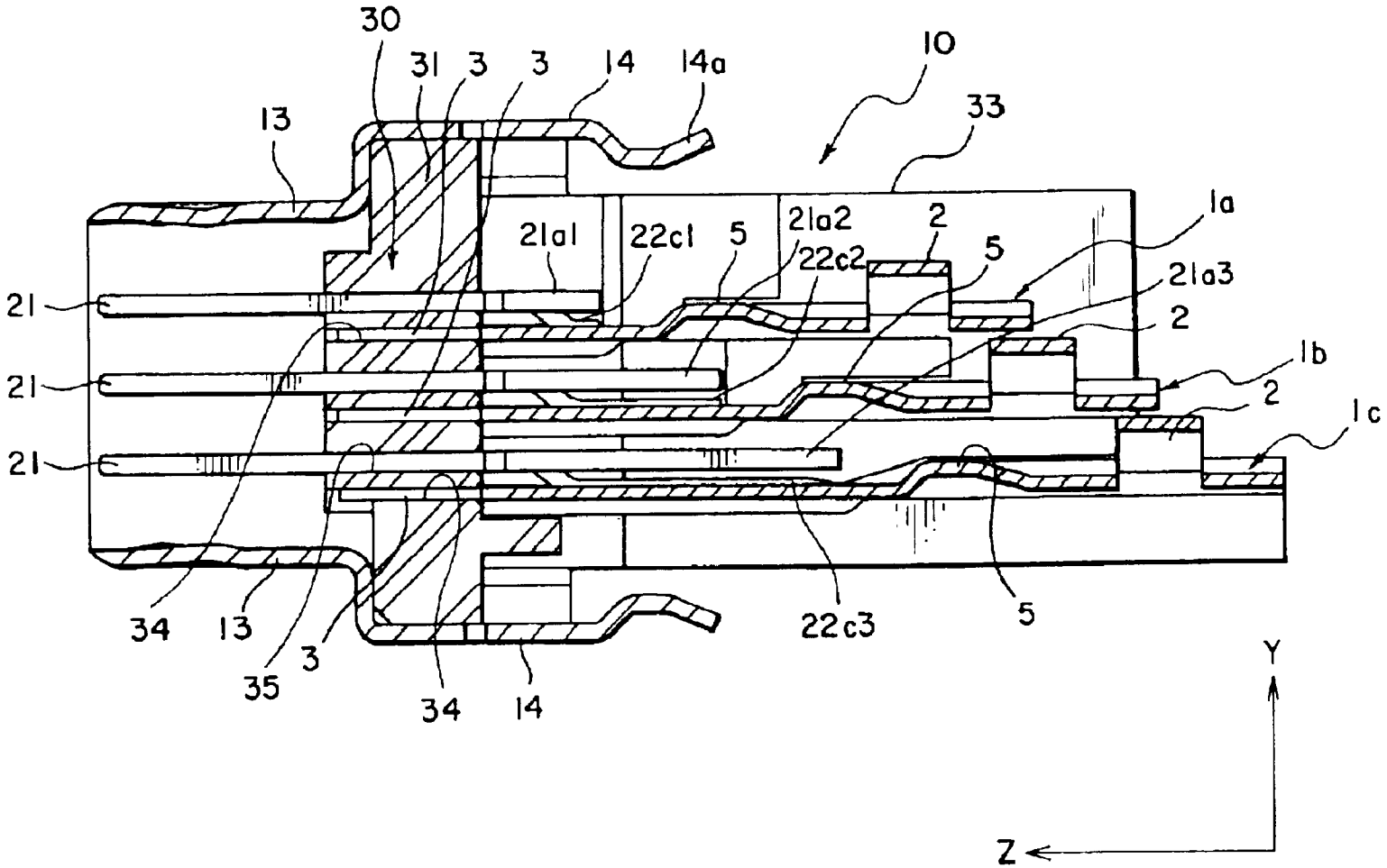
FIG. 8 is a cross-sectional view of the connector taken along lines VIII—VIII of FIG. 2.
Figure 9:
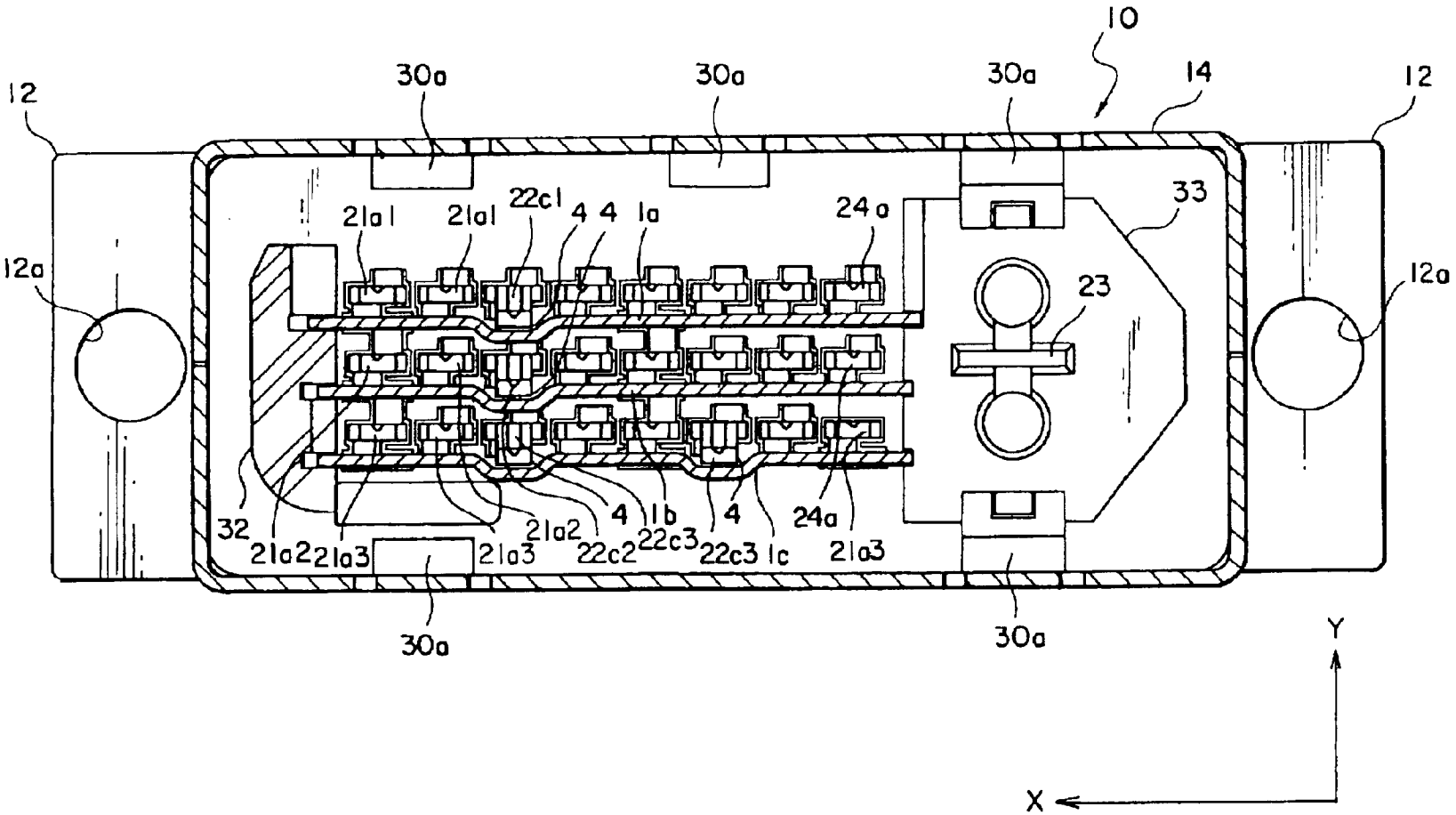
FIG. 9 is a cross-sectional view of the connector taken along lines IX—IX of FIG. 6.

As clearly shown in FIGS. 7–9, the ground plates 1 (1*a*, 1*b*, 1*c*) comprise cable holders 2, depressed portions 4, and bulges 5. On the depressed portions 4, the third portions 22*c*1 to 22*c*3 of the ground contacts 22 are disposed. The depressed portions 4 serve as banks to accommodate therein the solder material when the third portions 22*c*1 to 22*c*3 are connected to the ground plates 1*a* to 1*c* by soldering. Each of the bulges 5 is formed in the respective ground plate 1*a* to 1*c* so that a predetermined space becomes left between the bulge 5 and a corresponding one of the contacts 21, 24 when the connector 10 is assembled. In order to adjust every signal path to have suitable impedance, the tail portion 21*a*1, 21*a*2, 21*a*3 straightly extends in parallel to the ground plate 1, and the predetermined space is set between tail portion 21*a*1, 21*a*2, 21*a*3 and the ground plate 1 for the same reason. The bulge 5 serves to mount thereon at least one coaxial cable, especially, an inner insulator of the coaxial cable when the coaxial cable is connected to the connector 10. The bulge 5 has a predetermined height so as to adjust a center conductor of the coaxial connector to its position in which the center conductor can be connected to the contact 21 suitably. Additionally referring to FIG. 11, each of the cable holders 2 has a cross-section of a half-loop, especially, a half of a substantial hexagon cylinder extending in the Z-direction. Each of the cable holders 2 is formed by making two slits in the ground plate 1 at positions spaced therebetween in the Z-direction and then pulling up the center of the portion sandwiched by the slits. Each of the cable holders 2 holds two coaxial cables and positions the heights of the coaxial cables in cooperation with a corresponding one of the bulges 5.

Next explanation is made of a connection of coaxial cables to the connector 10, with reference also to FIGS. 13 to 20.

Figure 17:
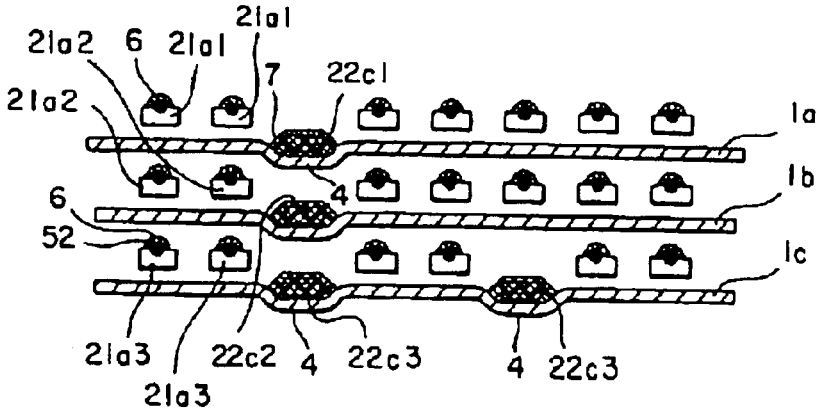
FIG. 17 is a view for use in describing the soldering process in the connector of FIG. 13.
Figure 18:
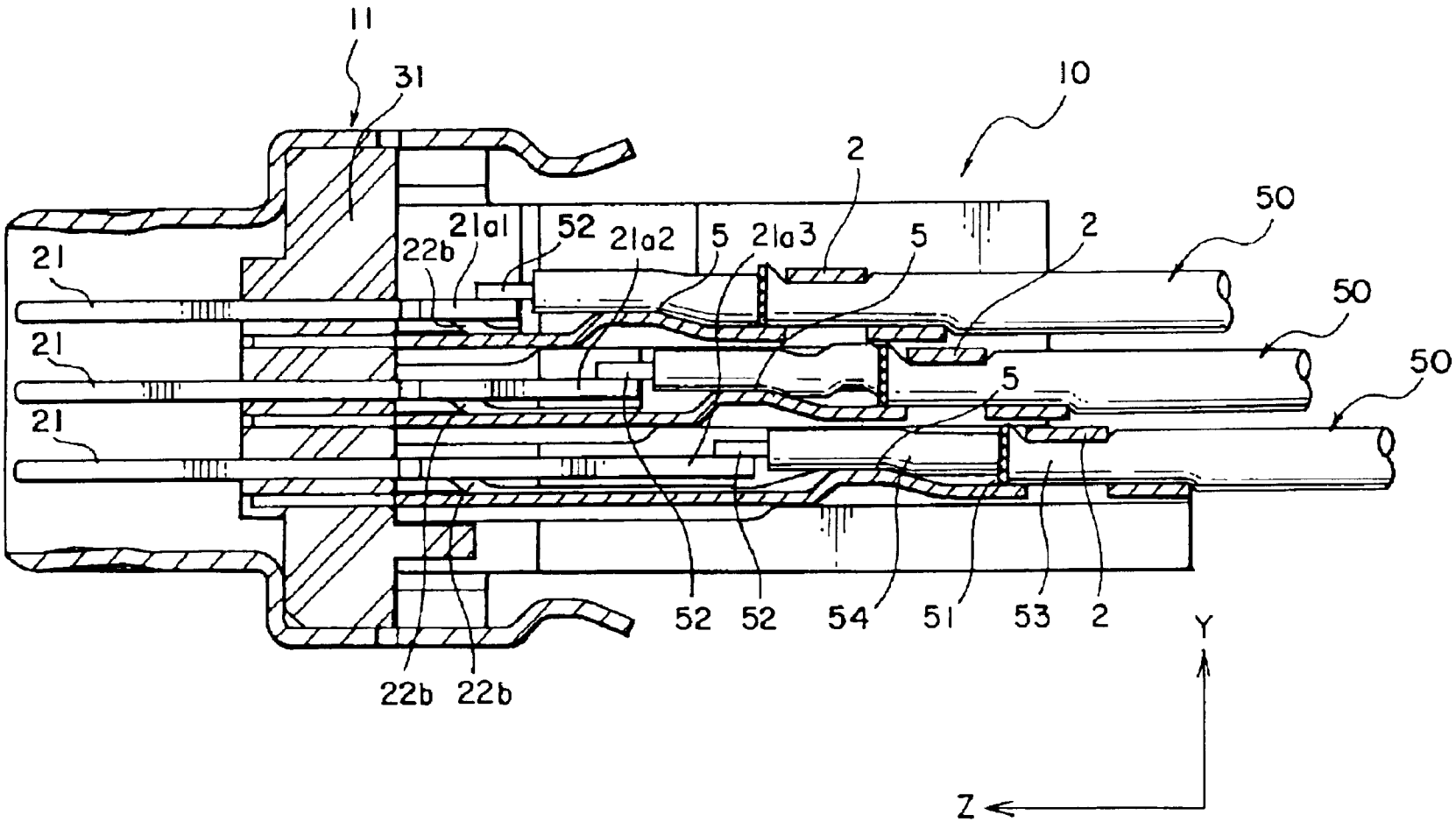
FIG. 18 is a cross-sectional view of the connector taken along lines XVIII—XVIII of FIG. 16.

A pair of coaxial cables 50 are inserted into the cable holder 2 from the rear side of the connector 10 with outer covers 53 of the coaxial cables 50 being partially removed. Then, the coaxial cables 50 are held at the outer covers 53 remained thereon by the cable holder 2, while the inner insulators 54 of the coaxial cables 50 are mounted on the bulge 5 so that the coaxial cables 50 are fixed in the Y-direction and center conductor 52 of the coaxial cables 50 are adjusted to their positions in which the center conductors 52 can be suitably connected the respective contacts 21, as shown in FIG. 18. Two outer conductors 51 of the coaxial cables 50 are bundled and connected to a corresponding one of the third portions 22*c*1 to 22*c*3 of the ground contacts 22 by soldering. At the time of soldering, the depressed portion 4 receives the solder material 7 so that the solder material 7 does not have a bad influence on the impedance of the signal contacts 21 positioned nearer to the ground contact 22, as shown in FIG. 17. On the other hand, the center conductors 52 are soldered to two corresponding signal contacts 21, respectively, with soldering material 6, as shown in FIG. 17.

Figure 19:
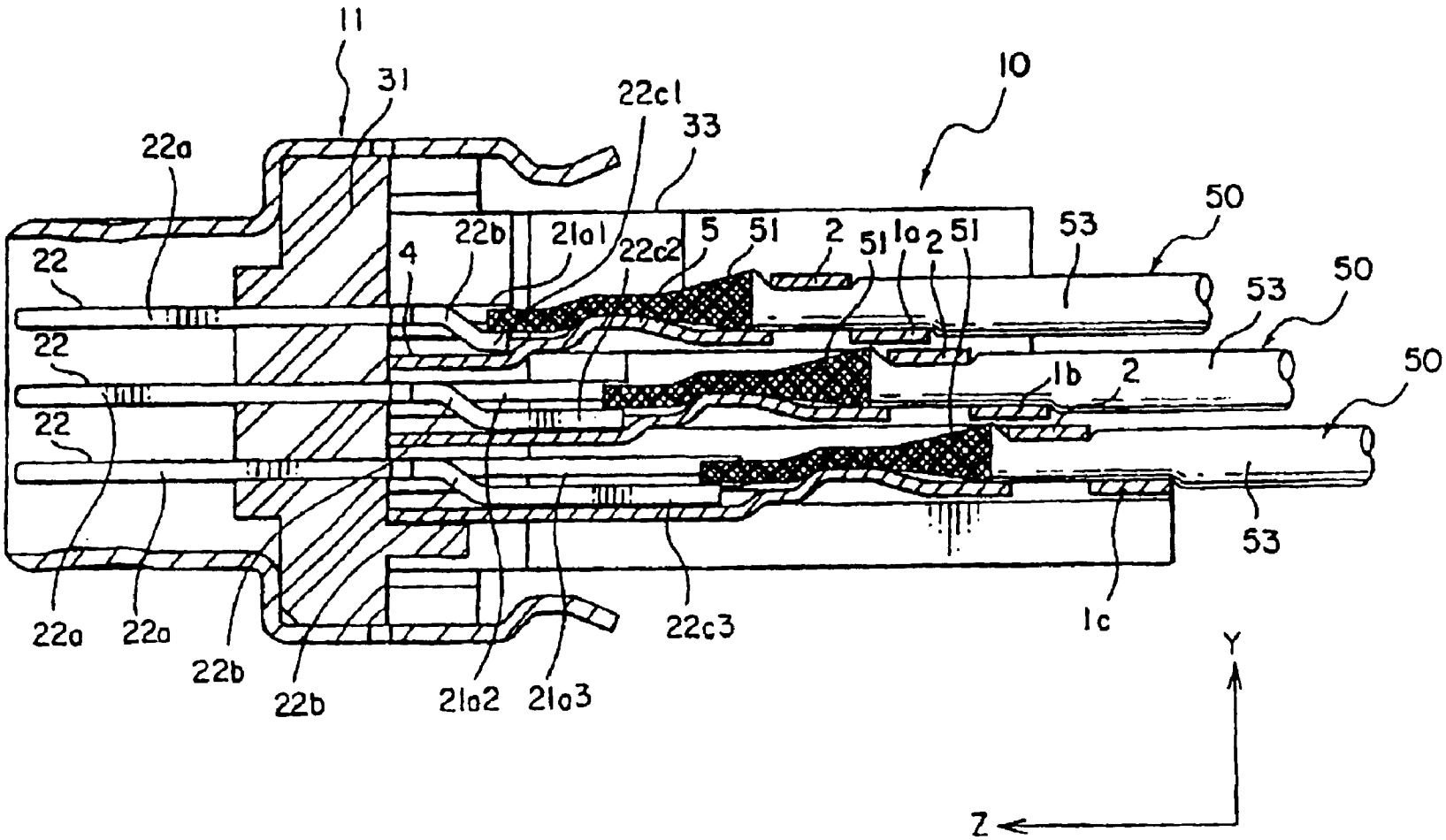
FIG. 19 is a cross-sectional view of the connector taken along lines XIX—XIX of FIG. 16.
Figure 20:
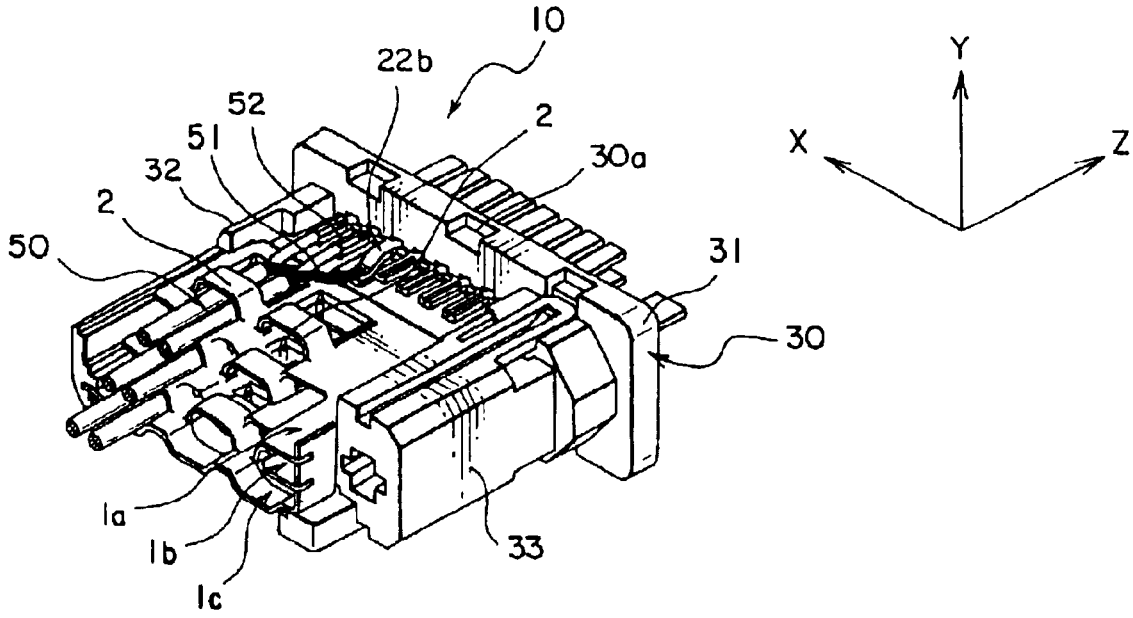
FIG. 20 is a perspective view of the insulator housing as seen from the rear of the insulator housing, with the shell of the connector of FIG. 13 removed.

As seen from the figures, especially FIGS. 18 and 19, the ground plate 1 is designed to substantially form a microstrip line together with the contact 21, the center conductor 52 of the coaxial cable 50, and the atmosphere (usually, the air) surrounding the connector 10. The atmosphere serves as a dielectric portion of the microstrip line. Therefore, the impedance of the signal line is kept suitably.

Although a pair of coaxial cables are exampled as carriers of a pair of high-speed signals, a twin axial cable may be adopted as the carries of the pair of high-speed signals. In this case, it is preferable that a drain line of the twin axial cable is connected to the ground contact 22.

In addition, a single cable holder 2 has been explained to hold two coaxial cables 50 but it may hold one coaxial cable.

Figure 21:
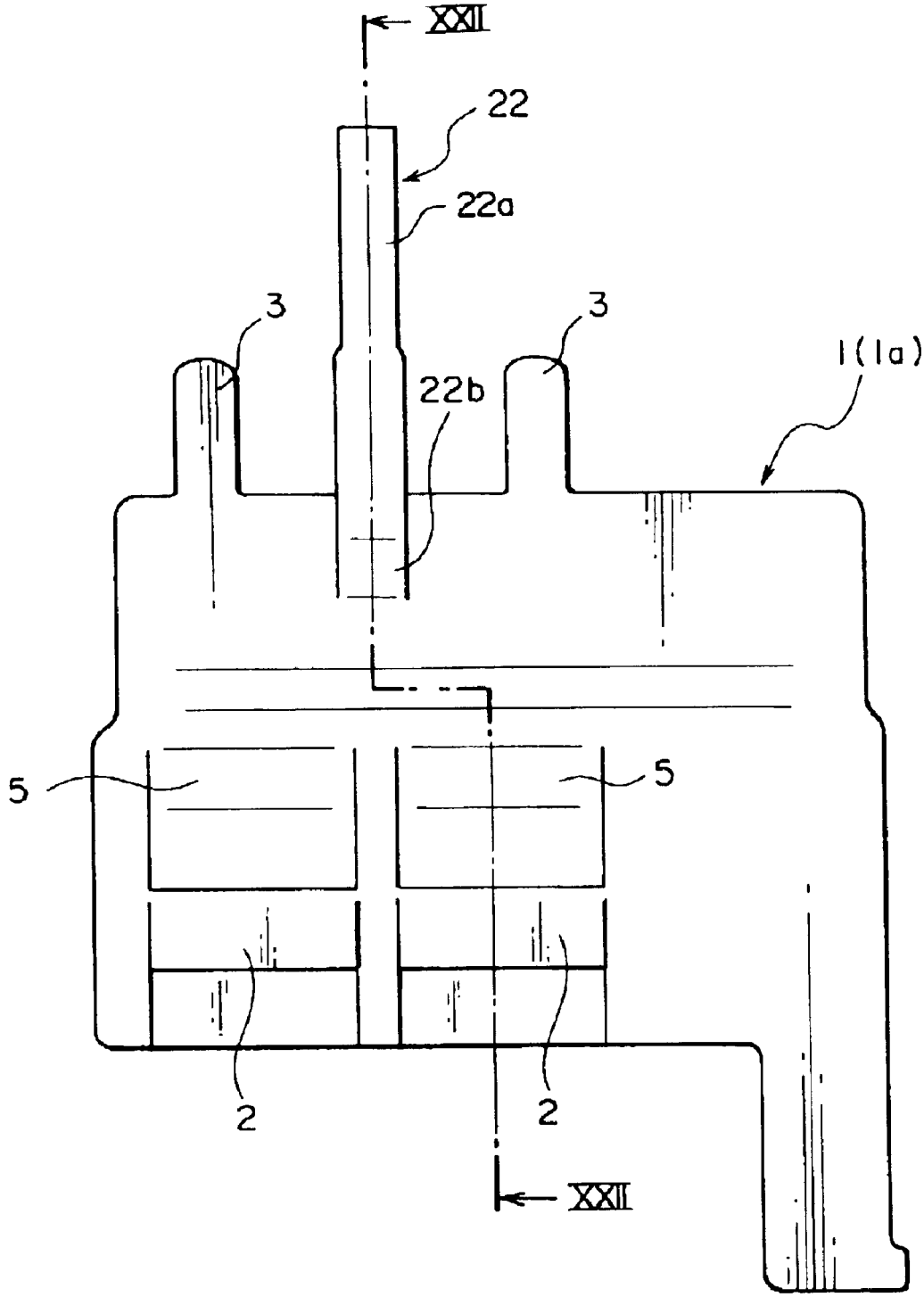
FIG. 21 is a top plan view of a ground plate which is a modification of that of the connector of FIG. 1.
Figure 22:
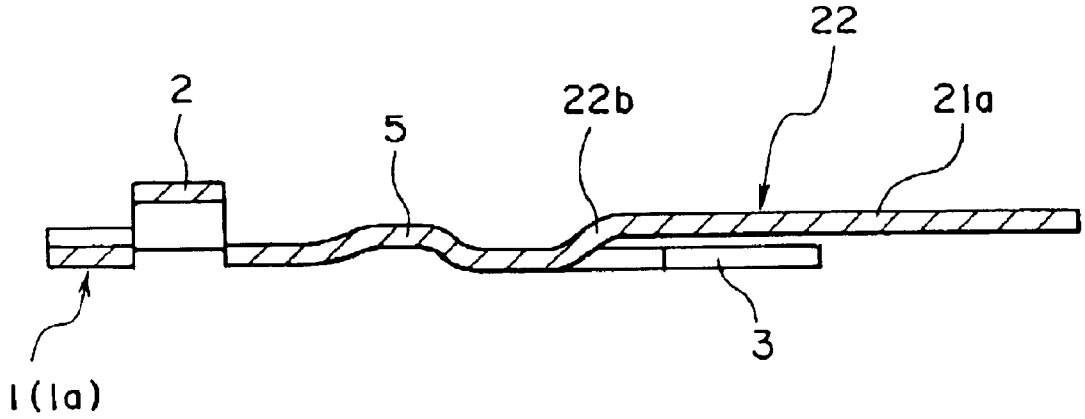
FIG. 22 is a cross-sectional view of the ground plate of the modification taken along lines XXII—XXII of FIG. 21.

Furthermore, the ground contact 22 is formed integrally with the ground plate 1. By way of example, the ground plate 1 with the ground contact 22 is shown in FIGS. 21 and 22, which can be used in correspondence with the ground contacts 22 of the top and the middle rows. As seen from the figures, each of the third portions of the ground contacts 22 forms a part of the ground plate 1.

What is claimed is:

1. A connector for connecting at least first and second signal lines and a ground line with a mating connector fitable to said connector, said connector comprising:

first and second contacts to be connected with said first and second signal lines, respectively;

a ground contact to be connected with said ground line;

a ground plate electrically connected with said ground contact;

an insulator supporting therein said first and second contacts and said ground contact in accordance with predetermined pin assignments where said first and second contacts and said ground contact are arranged in row so that said first contact is positioned farther than said second contact from said ground contact; and a conductive finger portion electrically connected with said ground plate and which is arranged in the proximity of said first contact, a first portion straightly extending in an insertion direction of the connector and supported by said insulator;

a second portion extending from said first portion and making an obtuse angle with said first portion; and a third portion extending from said second portion and making an obtuse angle with said second portion so as to be parallel to said first portion and to be connected to said ground plate, at least one column of ground contacts each of which comprises said first to third portions, wherein said first and second contacts are a pair of positive and negative contacts or another pair of negative and positive contacts to form a differential pair of signal contacts, said conductive finger portion being positioned with said first contact in the column direction perpendicular to said row.

2. The connector according to claim 1, wherein said third portions of ground contacts in said column are formed longer as being arranged lower in said column.

3. The connector according to claim 1, further comprising at least first and second columns of signal contacts, each of said signal contacts in said first column and each of said signal contacts in said second column serving as said first contacts and said second contacts (21) in each row.

4. The connector according to claim 1, wherein a plurality of first and second signal contacts and a plurality of ground contacts are arranged in rows and columns of a matrix so that at least one pair of first and second signal contacts and at least one ground contact are arranged in this order in each of the rows, while contacts in first, second and third columns adjacent to each other are the first and second signal contacts and the ground contacts arranged in said rows.

5. The connector according to claim 1, for accommodating twin-axial cable as a pair of said first and second signal lines and said ground line, said connector further comprising a cable holder for holding said twin-axial cable.

6. The connector according to claim 1, wherein said insulator has first to third through holes and an additional hole, said first to third through holes being arranged in the same horizontal line so as to be inserted thereinto said first and second contacts, and said ground contact, respectively, in accordance with said predetermined pin assignments, said additional hole accommodating therein said conductive finger portion and being located above or below said first through hole in the insulator.

7. The connector according to claim 1, wherein said conductive finger portion is formed integrally with said ground plate.

8. The connector according to claim 1, wherein said ground contact comprises:

a first portion straightly extending in an insertion direction of the connector and supported by said insulator;

a second portion extending from said first portion and making an obtuse angle with said first portion; and a third portion extending from said second portion and making an obtuse angle with said second portion so as to be parallel to said first portion and to be connected to said ground plate.

9. The connector according to claim 8, wherein said ground contact is formed integrally with said ground plate.

10. The connector according to claim 8, wherein said ground contact is formed not integrally with said ground plate but is electrically connected with said ground plate.

11. The connector according to claim 1, for accommodating center conductors in first and second coaxial cables as a pair of said first and second signal lines, respectively, said first and second coaxial cables having outer conductors, and for also accommodating said outer conductors together as said ground line, said connector further comprising a cable holder for holding at least one of said first and second coaxial cables.

12. The connector according to claim 11, wherein said cable holder is formed on said ground plate and has a cross-section of a substantial half-loop.

13. A connector for connecting at least first and second signal lines and a ground line with a mating connector fitable to said connector, said connector comprising:

first and second contacts to be connected with said first and second signal lines, respectively;

a around contact to be connected with said around line;

a around plate electrically connected with said ground contact;

an insulator supporting therein said first and second contacts and said ground contact in accordance with predetermined pin assignments where said first and second contacts and said ground contact are arranged in row so that said first contact is positioned farther than said second contact from said ground contact; and a conductive finger portion electrically connected with said ground plate and which is arranged in the proximity of said first contact, a first portion straightly extending in an insertion direction of the connector and supported by said insulator;

a second portion extending from said first portion and making an obtuse angle with said first portion; and a third portion extending from said second portion and making an obtuse angle with said second portion so as to be parallel to said first portion and to be connected to said around plate, a depressed portion which receives said third portion of said ground contact at said ground plate, wherein said first and second contacts are a pair of positive and negative contacts or another pair of negative and positive contacts to form a differential pair of signal contacts, said conductive finger portion being positioned to confront with said first contact in a column direction perpendicular to said row, said ground contact not being formed integrally with said ground plate but electrically connected with said wound plate.

14. A connector for connecting at least first and second signal lines and a around line with a mating connector fitable to said connector, said connector comprising:

first and second contacts to be connected with said first and second signal lines, respectively;

a around contact to be connected with said around line;

a around plate electrically connected with said around contact;

an insulator supporting therein said first and second contacts and said around contact in accordance with predetermined pin assignments where said first and second contacts and said ground contact are arranged in row so that said first contact is positioned farther than said second contact from said ground contact; and a conductive finger portion electrically connected with said ground plate and which is arranged in the proximity of said first contact, wherein said first and second contacts are a pair of positive and negative contacts or another pair of negative and positive contacts to form a differential pair of signal contacts, said conductive finger portion being positioned to confront with said first contact in a column direction perpendicular to said row;

wherein a plurality of first and second signal contacts and a plurality of ground contacts are arranged in rows and columns of a matrix so that at least one pair of first and second signal contacts and at least one ground contact are arranged in this order in each of the rows, while contacts in first, second and third columns adjacent to each other are the first and second signal contacts and the ground contacts arranged in said rows, wherein said first contacts of said first column comprise tail portions formed longer as being arranged lower in said first column, while said second contacts of said second column comprise tail portions formed longer as being arranged lower in said second column.

15. A connector for connecting at least first and second signal lines and a ground line with a mating connector fitable to said connector, said connector comprising:

first and second contacts to be connected with said first and second signal lines, respectively;

a ground contact to be connected with said around line;

a ground plate electrically connected with said ground contact;

an insulator supporting therein said first and second contacts and said around contact in accordance with predetermined pin assignments where said first and second contacts and said ground contact are arranged in row so that said first contact is positioned farther than said second contact from said ground contact; and a conductive finger portion electrically connected with said ground plate and which is arranged in the proximity of said first contact, wherein said first and second contacts are a pair of positive and negative contacts or another pair of negative and positive contacts to form a differential pair of signal contacts, said conductive finger portion being positioned to confront with said first contact in a column direction perpendicular to said row, first and second coaxial cables as a pair of said first and second signal lines, respectively, said first and second coaxial cables for accommodating center having outer conductors, and for also accommodating said outer conductors together as said ground line, said connector further comprising a cable holder for holding at least one of said first and second coaxial cables; and said first and second coaxial cables further comprising inner insulators covering said first and second signal lines, wherein said ground plate has a bulge with a predetermined space left between said bulge and tail portions of a pair of said first and said second contacts.

16. The connector according to claim 15, wherein said bulge is used to mount thereon said inner insulators of said coaxial cables and has a predetermined height so as to adjust said pair of first and second signal lines to their positions in which said pair of first and second signal lines can be connected to said pair of first and second contacts suitably.

* * * * *